US006926534B2

(12) United States Patent
Dollhofer

(10) Patent No.: US 6,926,534 B2
(45) Date of Patent: Aug. 9, 2005

(54) MOUNTING DEVICE FOR SLIDING CONTACTS

(75) Inventor: Kurt Dollhofer, Fuerstenfeldbruck (DE)

(73) Assignee: Schleifring und Apparatebau GmbH (DE)

( * ) Notice: Subject to any disclaimer, the term of this patent is extended or adjusted under 35 U.S.C. 154(b) by 201 days.

(21) Appl. No.: 10/216,368

(22) Filed: Aug. 8, 2002

(65) Prior Publication Data

US 2003/0054672 A1 Mar. 20, 2003

(51) Int. Cl.[7] ..... H01R 39/00
(52) U.S. Cl. ..... 439/26; 174/52.2
(58) Field of Search ..... 439/23, 24, 25, 439/26, 67; 174/54.2

(56) References Cited

U.S. PATENT DOCUMENTS 3,574,266 A 4/1971 Ahmed ..... 446/136
3,614,726 A 10/1971 Richter, Jr. et al. ..... 340/854.3
RE32,805 E * 12/1988 Engelmore et al. ..... 439/26
5,865,629 A * 2/1999 Bernardini ..... 439/26

FOREIGN PATENT DOCUMENTS

EP 0662736 7/1995

* cited by examiner

*Primary Examiner*—Phuong T. Vu
(74) *Attorney, Agent, or Firm*—St. Onge Steward Johnston & Reens

(57) ABSTRACT

The invention relates to a holding device for sliding contacts. The holding devices so far known require a very high expenditure for mounting or alignment. A flexible printed circuit board with mechanically rigid carrier elements that permit the adaptation to the geometry of the slipring enables a simple and low-cost structure.

13 Claims, 2 Drawing Sheets

MOUNTING DEVICE FOR SLIDING CONTACTS

This application claims priority of pending German Application No. 101 40 014-4 filed on Aug. 9, 2001.

FIELD OF THE INVENTION

The present invention relates to a locating device for sliding contacts of the type used particularly with slip rings for the transmission of electrical signals between parts rotating relative to each other.

BACKGROUND OF THE INVENTION

With conventional slip rings for the transmission of signals or for transmitting minor and medium currents, metal wires are preferably employed which run on round sliprings. In such a design, the metal spring is guided by an appropriate holder means relative to the slipring in such a manner that it is constantly maintained in a mechanically biased condition. This bias is required in order to ensure that a proper contact will be continuously maintained even in the case of positional tolerances and movements of the spring relative to the slipring. An example of such a locating device is disclosed in the U.S. Pat. No. 3,574,266. Such arrangements with a single contact spring only produce a comparatively high contact noise in operation, i.e. when the slipring is rotating. This contact noise is created by minute movements of the metal spring on the surface of the slipring.

Systems having more than just one metal spring display substantially better contact characteristics. In these cases, a parallel circuit including several possible current paths can be achieved. For example, when the contact between the first contact spring and the slipring is discontinued for a short period the current may continue flowing via a further contact spring. The probability of the second or of further contact wires losing the contact with the slipring at the same time is extremely low. Such a system with two contact wires is described in the U.S. Pat. No. 3,614,726. This system comprises pairs of contact wires fastened by means of soldered joints on a common locating and contacting wire. Even though such a system has good contacting characteristics it can be produced only with great difficulties because the contacting wires, the contact wires and the electrical terminal must be joined by soldering them individually. In the case of a slip ring assembly with a few contacts only, this work is less relevant than in the case of slip ring assemblies with high numbers of contacts. Apart therefrom, the spacing between the individual sliding contact wires is comparatively wide in such an arrangement so that in the case of many contacts consequently very large dimensions of the entire arrangement are achieved.

This problem is solved by an arrangement disclosed in the European Patent specification EP 0 662 736 B1. There, the contact spring is accommodated in a carrier consisting of an electrically conducting material or as printed circuit board coated with an electrically conductive material. In the case of sliprings having a comparatively small diameter, the contact spring may here be inserted into the carrier in a vertical position. With wider slipring diameters, the contact spring is bent closely towards the carrier at an appropriate angle.

This bending operation, however, must mostly be performed by hand, which requires, in its turn, a high expenditure in terms of labour. Moreover, when usual contact wires are used, which consist only of a single wire, the restitution constant is varied as a result of the deformations of the material at the site of the bend (cold hardening). Even though the manual alignment furnishes uniformly oriented contact wires these wires have different restitution constants and hence different forces pressing against the sliprings.

SUMMARY OF THE INVENTION

The invention is based on the problem of providing a mounting means for contact wires (brushes), which does no longer present the aforedescribed disadvantages and which is easy to mount and to align, in particular, whilst it enables constant contact pressures of the contact wires.

One inventive solution to this problem is defined in Patent claim 1. Improvements of the invention are the subject matters of the dependent claims.

The inventive device consists of at least one flexible printed circuit board for contacting the contact wires, which is rigidified by stiffening elements for mechanically fixing the contact wires in such a way that it is able to take up the spring forces. In the present context, the term "flexible printed circuit board" in the sense of the invention is to be understood to denote the usual embodiment of flexible printed circuit boards with a dielectric substrate and conductor structures laminated thereon. This term equally encompasses also conductor structures consisting of a conductive material, which display properties of mechanical flexibility, such as conductor structures punched out of a thin metal sheet.

In accordance with the present invention, at least one flexible printed circuit board may be used for indirectly or directly contacting the contact wires as well as for mechanically holding them indirectly or directly. It is possible, for example, to fasten the contact wires by soldering them directly to soldering tags of the flexible printed circuit board. This leads to the establishment of a direct electrical contact. Indirect electrical contacting is possible because the carrier element or elements are contacted by the flexible printed circuit board and the contact wires are fixed in the carrier elements in such a way that they contact them electrically at the same time. The carrier elements as such may also be designed in the form of a mechanically rigid printed circuit board. Now the contact wires can be mechanically fixed in this printed circuit board by soldering, which creates a mechanical fixing and provides for electrical contacting at the same time.

Owing to the configuration of the locating and contacting means for the contact wires with a flexible printed circuit board, it is now possible to carry isolated groups of contact wires individually into the optimum position relative to the slipring. Hence, an optimum sliding position can be achieved in combination with the optimum contact pressure. The alignment is here carried out by precise positioning of the locating means rather than by bending of the individual contact wires. Hence, the initial restitution constant of the contact spring material is not influenced by cold hardening. Consequently, all contact wires now present similar resilience characteristics as far as possible. Moreover, there is no risk of overbending of the individual wires at a bending position. Owing to the optimum adaptation to the slipring extension, it is now possible as well to use shorter wires of the contact wires. As a result, a reduced mass is achieved with a higher limit frequency of the system, which results in a higher stability at strong vibrations, e.g. in vehicles.

In another expedient embodiment of the invention, at least one flexible printed circuit board is configured in the form of a rigid and flexible printed circuit board. With such printed circuit boards, rigid and flexible parts are joined by lamination. Consequently, a mechanically reliable connection of these elements is achieved in a single step. The electrical contacts are established by means of conductor paths located on both the rigid zones and the flexible zones.

In a further advantageous embodiment of the invention, at least one flexible printed circuit board or at least one carrier element is provided for receiving a plug or another connector means. Hence, a unit ready for connection can be produced for the accommodation of the contact wires. With the selection of a suitable mounting location it is possible to take special conditions into consideration such as a certain minimum rigidity of the mounting area of the plug or a maximum thickness of the printed circuit board.

Another preferred embodiment of the invention is characterised by the feature that additional active or passive components are mounted either on at least one flexible printed circuit board or on at least one carrier element. With slip rings, additional components such as filters, amplifiers, resistors or even fuses are often required. These elements are here particularly simple to integrate into one assembly. Specifically with major components it becomes possible to fasten them on the mechanically rigid carrier element because in the event that they are mounted on the flexible printed circuit board they could leap off after the printed circuit board has been bent.

In accordance with a further expedient embodiment of the invention, the mechanically rigid carrier elements are fastened by means of stable support members. These support members fix the carrier elements and the contact wires connected thereto in predetermined positions. The support members as such may be fastened in the housing of the slip ring, for instance.

Another embodiment of the invention provides for a movable or adjustable arrangement of the support members. With such a movable arrangement, it is possible to adjust the bearing angle or the contact pressure of the contact wires on the slipring. In distinction from prior art, such an arrangement permits even the alignment in the built-in condition and even with rotating sliprings. Apart therefrom, only an individual adjustment of the contact wires is possible in arrangements corresponding to prior art. On account of the fact that the contact wires are uniformly fixed by the carrier elements without alignment. Hence, an individual alignment is no longer required at all. Due to the complete alignment of all contact wires in a single operation by adjustment of the carrier elements or of the support members connected therewith, respectively, substantial savings can be achieved in labour—at an enhanced precision in alignment whilst misalignment of individual contact wires can be precluded. A locking means must be provided, of course, on the support members as well so that the latter may be permanently fixed for operation after alignment.

In accordance with the present invention, a method is proposed for electrically contacting sliding contacts running on sliprings for the rotary transmission of electrical signals. In that method, the sliding contacts are contacted by the employment of at least one flexible printed circuit board.

BRIEF DESCRIPTION OF THE DRAWINGS

The invention will be described in the following by exemplary embodiments, without any restriction of the general inventive idea, with reference to the drawings wherein.

DETAILED DESCRIPTION OF THE DRAWINGS

Figure 1:
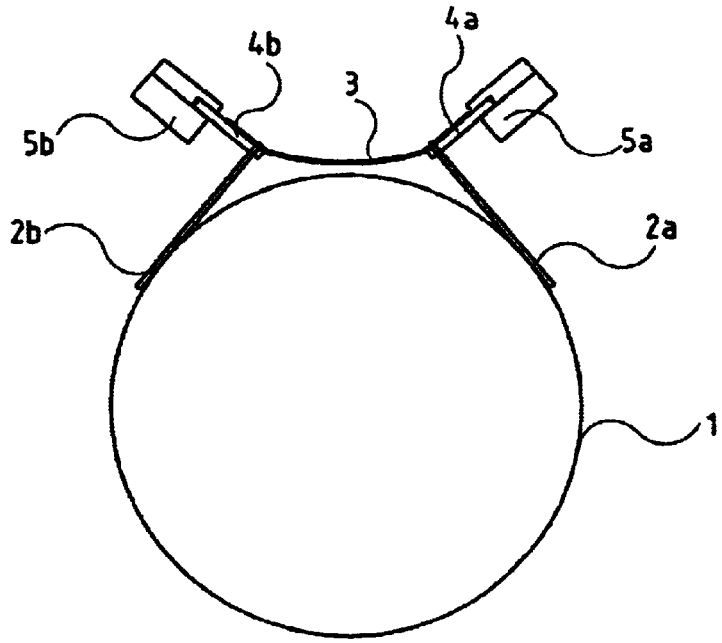
FIG. 1 illustrates a general embodiment of the invention, which comprises support members.

FIG. 1 illustrates an inventive device in a general form. There, a first set of contact wires (2*a*) as well as a second set of contact wires (2*b*) runs along a slipring (1). The contact wires are mechanically fixed by means of a first mechanically rigid carrier element (4*a*) as well as by means of a second mechanically rigid carrier element (4*b*), which elements are connected to each other by means of a flexible printed circuit board (3).

Figure 2:
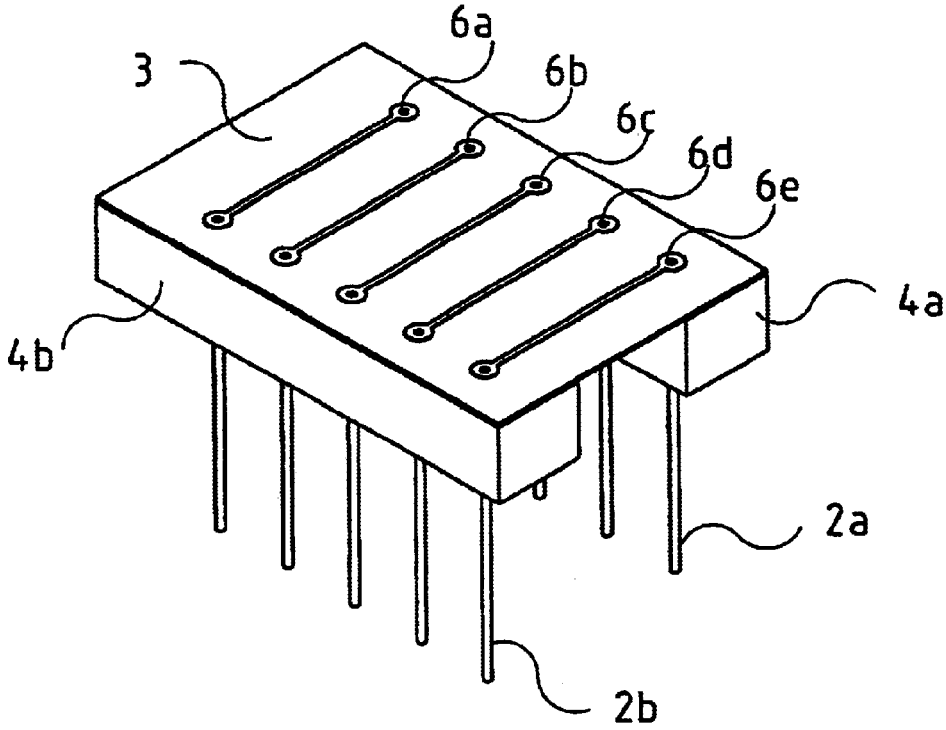
FIG. 2 an embodiment of the invention, which comprises conducting paths for contacting.

FIG. 2 is a perspective view of an inventive device comprising additional conducting paths for contacting and connecting the contact wires. Here, each of the contact wires of the first set of contact wires (2*a*) is connected to the corresponding contact wires of the second set of contact wires (2*b*) by means of the conducting paths (6*a*, 6*b*, 6*c*, 6*d*, 6*e*) disposed on the flexible printed circuit board (3).

Figure 3:
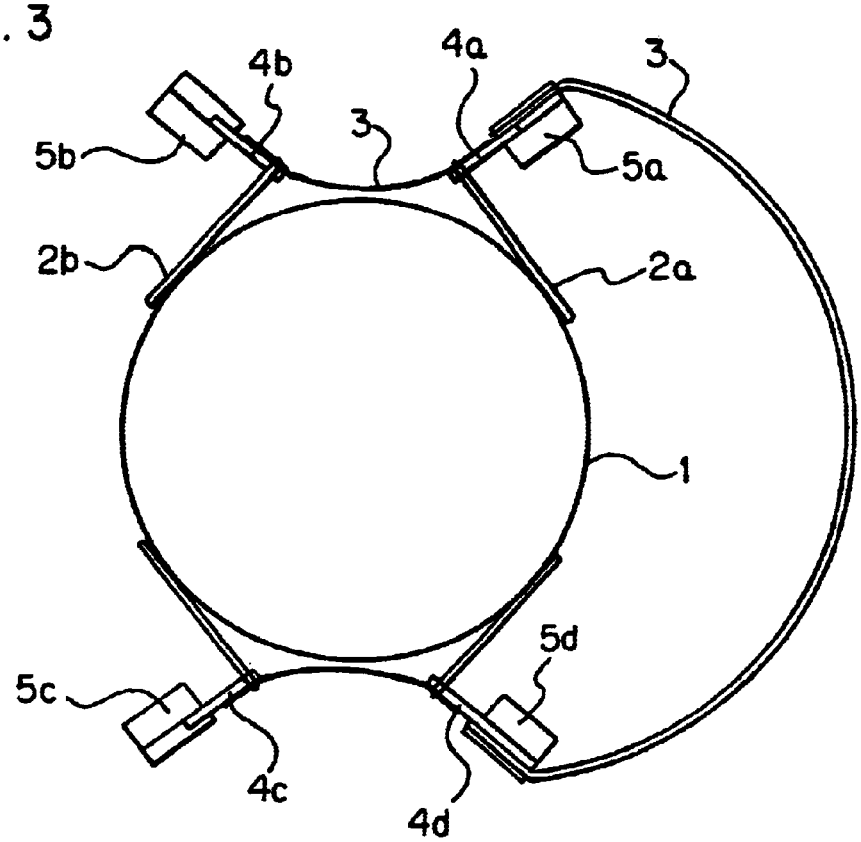
FIG. 3 is a view of a multiple arrangement of contact wires.

FIG. 3 discloses an exemplary array including four sets of contact wires running on a set of sliprings. Here, four contact wires run on each slipring. These wires are electrically connected to each other by means of a flexible printed circuit board.

Figure 4:
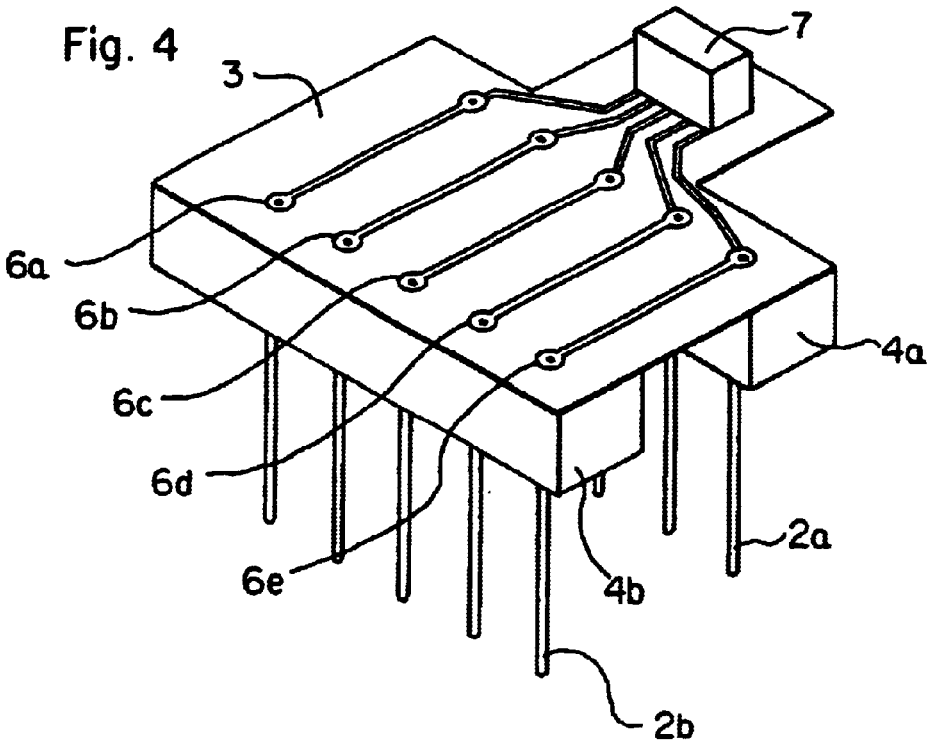
FIG. 4 shows an embodiment with an additional electronic component.

In FIG. 4, the additional integration of an electronic component on the flexible printed circuit board (3) is illustrated in an exemplary form. Such an electronic component may be a transformer, an amplifier or even a connector, for instance.

What is claimed is:

1. A device for holding and contacting contact wires for a slipring comprising:

a first set of resilient contact wires for contacting a slipring tangentially;

a stably supported first mechanically rigid carrier element for mechanically fixing and positioning the first set of resilient contact wires relative to the slipring;

at least one additional set of resilient contact wires for contacting the slipring tangentially;

one stably supported additional mechanically rigid carrier element for each additional set of resilient contact wires, for mechanically fixing and positioning the additional set or sets of resilient contact wires relative to the slipring positions; and conductor paths formed on at least one flexible printed circuit board extending between and joining the mechanically rigid carrier elements, for connecting contact wires of the first set of contact wires to corresponding contact wires of the additional set or sets of contact wires.

2. A device according to claim 1, wherein at least one of the flexible circuit boards electrically contacts at least some or all of the contact wires directly.

3. A device according to claim 1, wherein at least one of the carrier elements is configured as a rigid printed circuit board.

4. A device according to claim 1, wherein at least one of the flexible printed circuit boards is designed to have rigid zones and flexible zones laminated one on top of the other.

5. A device according to claim 1, wherein at least one of the flexible printed circuit boards is additionally designed for accommodating a connector means.

6. A device according to claim 5, wherein the connector means is a plug or a socket.

7. A device according to claim 1, wherein at least one of the flexible printed circuit boards comprises an active or a passive component.

8. A device according to claim 7, wherein the active or passive component is a filter or an amplifier.

9. A device according to claim 1, wherein the mechanically rigid carrier elements are supported on stable support members.

10. A device according to claim 1, wherein the carrier elements or stable support members supporting the carrier elements are adjustably mounted, so that a bearing angle or a contact pressure of sets of contact wires against the slipring can be adjusted.

11. A method for holding and contacting contact wires for a slipring comprising the steps of:

mechanically fixing a first set of resilient contact wires on a first mechanically rigid carrier element;

mechanically fixing at least one additional set of resilient contact wires on a respective additional mechanically rigid carrier element;

stably supporting each of the mechanically rigid carrier elements to fix each mechanically rigid carrier element and the contact wires connected thereto in a predetermined position relative to the slipring, so that the resilient contact wires of each set contact the slipring tangentially;

connecting contact wires of the first set of contact wires to corresponding contact wires of the additional set or sets of contact wires using conductor paths formed on at least one flexible printed circuit board joined to and extending between the mechanically rigid carrier elements of the sets of contact wires.

12. A slipring contacting device comprising:

a first set of contact elements contacting a slipring having corresponding slipring contact conductors;

a second set of contact elements corresponding to said first set of contact elements and contacting the slipring contact conductors;

a carrier element maintaining said first set of contact elements and said second set of contact elements in a fixed spatial relationship relative to each other;

a set of conductor paths electrically coupling said first set of contact elements with said corresponding second set of contact elements;

at least one of said first set or said second set of contact elements being adjustable relative to the slipring contact conductors;

wherein when a position of said at least one of said sets of contact elements is adjusted relative to the slipring contact conductor each of the contact elements are simultaneously adjusted.

13. The slipring contacting device according to claim 12 wherein said carrier element comprises rigid zones and flexible zones laminated one on top of the other such that said carrier element may be deformed for simultaneous adjustment said at least one set of contact elements.

* * * * *